US009109383B2

(12) United States Patent
Jeffries

(10) Patent No.: US 9,109,383 B2
(45) Date of Patent: Aug. 18, 2015

(54) BAR LOCK FOR A DOOR

(75) Inventor: Mark Steven Jeffries, Buford, GA (US)

(73) Assignee: Austin Hardware and Supply, Inc., Lee's Summit, MO (US)

( * ) Notice: Subject to any disclaimer, the term of this patent is extended or adjusted under 35 U.S.C. 154(b) by 536 days.

(21) Appl. No.: 12/062,255

(22) Filed: Apr. 3, 2008

(65) Prior Publication Data

US 2009/0250950 A1 Oct. 8, 2009

(51) Int. Cl.

| | |
|---|---|
| ***E05C 19/08*** | (2006.01) |
| *E05C 19/00* | (2006.01) |
| *E05B 17/00* | (2006.01) |
| *E05B 67/38* | (2006.01) |
| *E05B 83/10* | (2014.01) |

(52) U.S. Cl.

CPC ..... *E05C 19/001* (2013.01); *E05B 17/0025* (2013.01); *E05B 67/383* (2013.01); *E05B 83/10* (2013.01)

(58) Field of Classification Search

USPC ..... 292/259 R, 281, 285, DIG. 32; 70/101

See application file for complete search history.

(56) References Cited

U.S. PATENT DOCUMENTS

| | | | | |
|---|---|---|---|---|
| 3,370,877 | A * | 2/1968 | Hallberg | 292/285 |
| 4,397,488 | A * | 8/1983 | Pastva | 292/210 |
| 4,483,557 | A * | 11/1984 | Pastva | 292/218 |
| 4,844,524 | A * | 7/1989 | Pastva | 292/218 |
| 5,029,724 | A * | 7/1991 | Serio | 220/322 |
| 5,118,000 | A * | 6/1992 | Howell et al. | 220/315 |
| 5,314,218 | A * | 5/1994 | Nadherny | 292/256.5 |
| 5,562,316 | A | 10/1996 | Bullock et al. | |
| 6,733,053 | B2 * | 5/2004 | Hodge et al. | 292/336.3 |
| 6,854,775 | B2 | 2/2005 | Senn | |
| 6,860,530 | B2 * | 3/2005 | Senn | 292/285 |
| 7,000,958 | B2 * | 2/2006 | Garza et al. | 292/336.3 |
| 7,810,854 | B2 * | 10/2010 | Hodge et al. | 292/259 R |

* cited by examiner

*Primary Examiner* — Carlos Lugo
(74) *Attorney, Agent, or Firm* — Polsinelli PC

(57) ABSTRACT

A bar lock assembly for locking a door in a closed or secured position is described. The bar lock assembly includes a tubular bar having curved portions that transition into a hinge receiving portion. A handle is rotatably engaged to the tubular bar. Hinge assemblies receive the hinge receiving portions of the tubular bar. The hinge assemblies connect or attach the bar lock assembly to a frame of the door.

25 Claims, 16 Drawing Sheets

BAR LOCK FOR A DOOR

FIELD OF INVENTION

The present invention relates to a bar lock assembly for locking a door.

BACKGROUND OF INVENTION

Bar locks have been used to lock and secure cargo doors, primarily on cargo trailers. Bar locks are typically used to secure a large door closed. The prior art bar locks generally include hinge members that are welded to the bar. The hinge members of the prior art devices are manually intensive to form and the required welds tend to corrode and eventually fail. The welding also increases manufacturing costs. The prior art bar locks further require many components, which also increases manufacturing costs.

SUMMARY OF INVENTION

A bar lock assembly for locking a door in a closed or secured position is described. The bar lock assembly includes a tubular bar having curved portions that transition into a hinge receiving portion. A handle is rotatably engaged to the tubular bar. The hinge receiving portions of the tubular bar are rotatably connected to hinge assemblies. The hinge assemblies are mounted to a frame of the door.

BRIEF DESCRIPTION OF DRAWINGS

FIG. 7(*b*) is a sectional view of the hinge assembly with the bushing and the rivet removed.

DETAILED DESCRIPTION OF INVENTION

Herein is described a bar lock assembly for locking or securing a door in a closed position. The bar lock assembly may be used for locking or securing a closed door on a cargo van, truck, transport vehicle, etc. or other types of doors or coverings leading to a storage area or other compartment. The bar lock assembly described herein includes fewer components as compared to prior art devices. The bar lock assembly described herein includes fewer welds as compared to prior art devices. These welds often corrode, leading to failure. By using a single tubular bar with corners comprised of curved portions in the single tubular bar, the number of welds and number of components necessary to manufacture the bar lock assembly is significantly reduced. The tubular bar maintains a constant diameter throughout its bends or corners, thus providing a consistent contact surface on the outside diameter of the tubular bar that presses against the door in order to fully close or seal the door.

The bar lock assembly comprises the tubular bar, a handle mounted in a rotational engagement with the tubular bar, and hinge assemblies for rotatably mounting the tubular bar to a door frame at an entrance to a cargo area. The bar lock includes a tubular bar with approximately 90° round bends at both ends of the tubular bar leading to the hinge assemblies.

Figure 1:
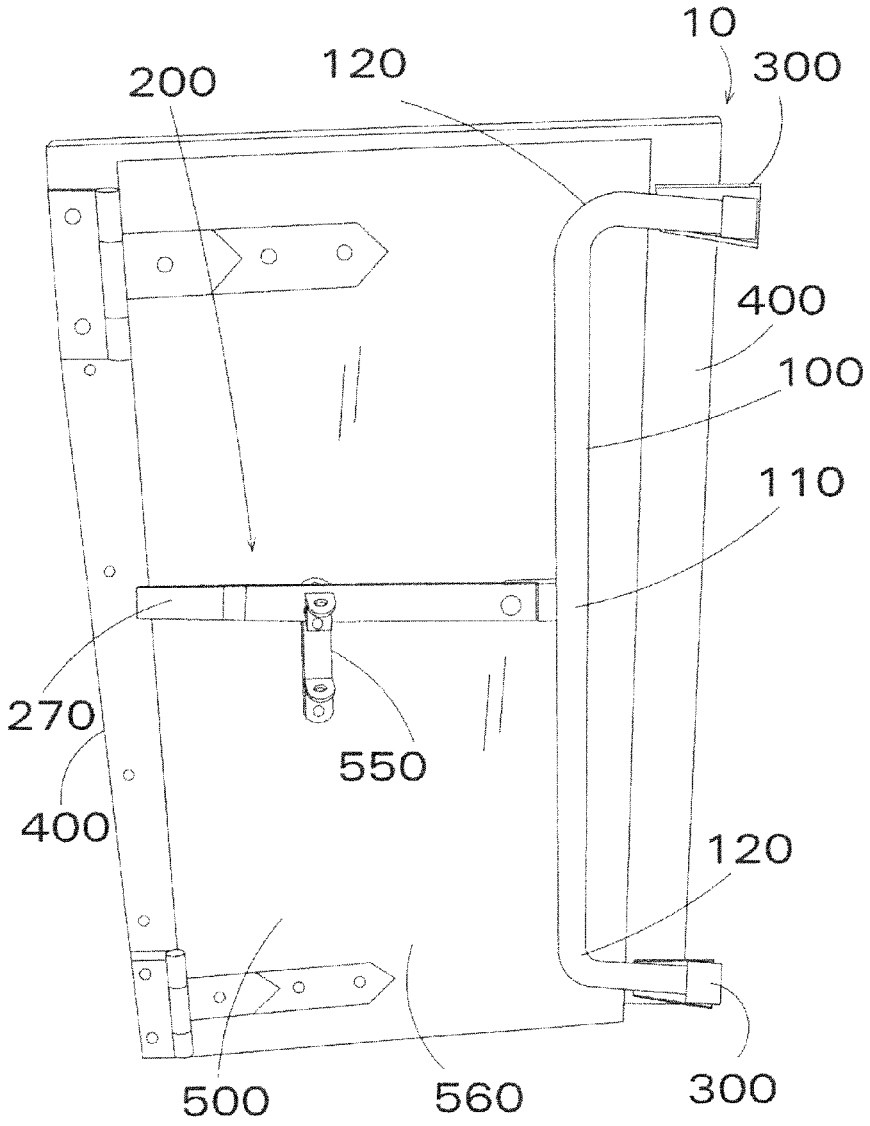
FIG. 1 is a view of the bar lock assembly in the locking position with the door closed over the cargo area.
Figure 2:
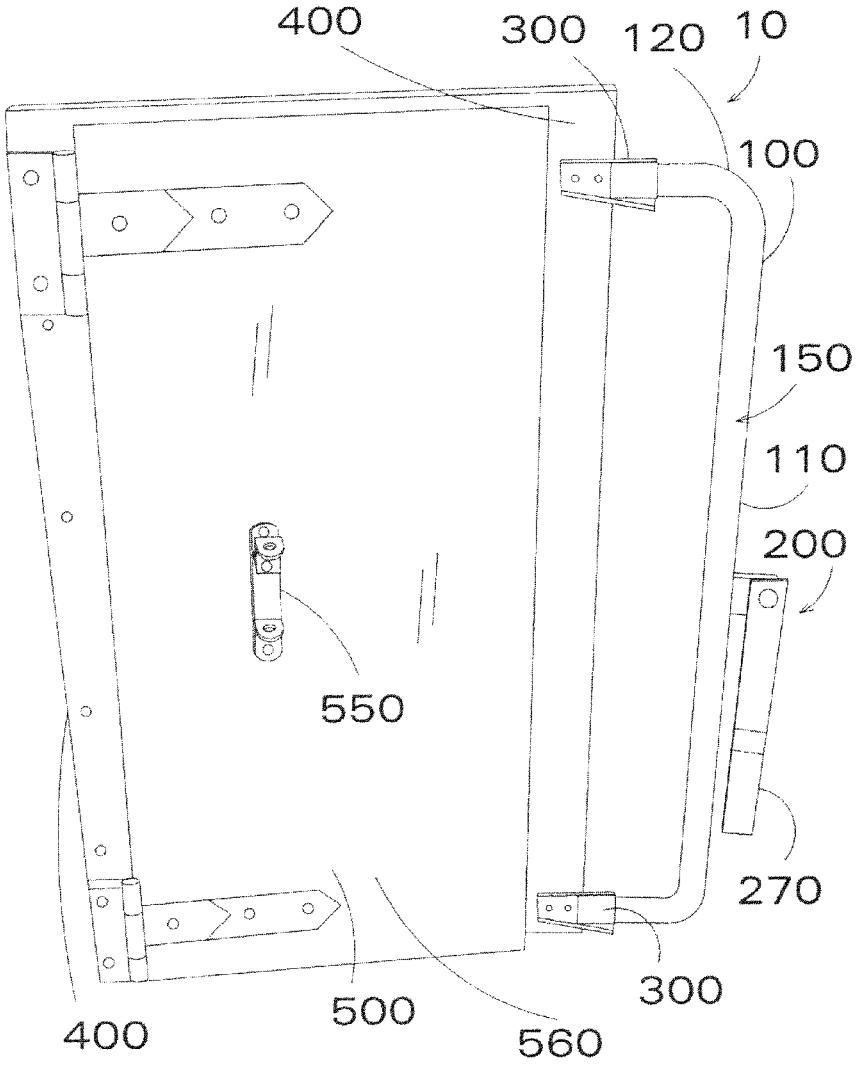
FIG. 2 is a view of the bar lock assembly in the open position with the door closed over the cargo area.
Figure 3:
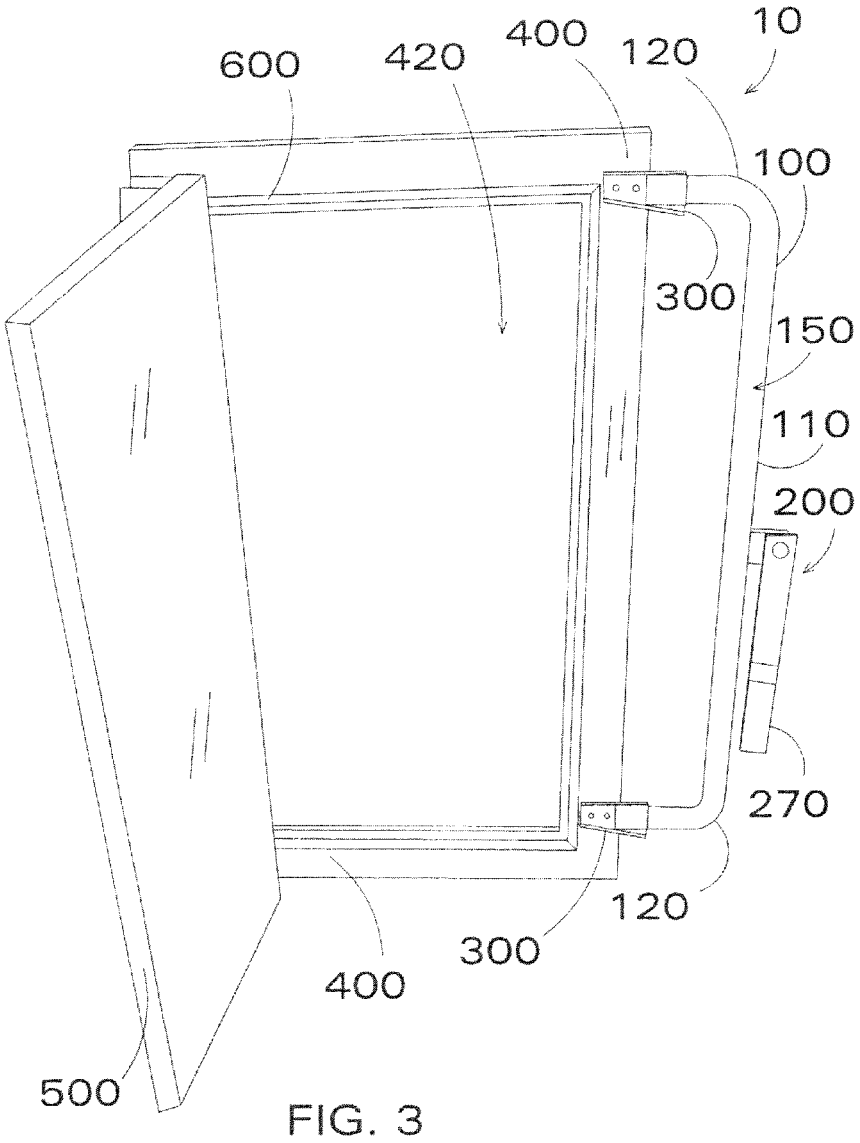
FIG. 3 is a view of the bar lock assembly in the open position with the door opened revealing the cargo area.

With reference to FIGS. 1-3, a bar lock assembly 10 is shown. The bar lock assembly 10 is installed on a door frame 400 in order to secure a door 500 closed to conceal or close a cargo area 420. FIG. 1 shows the bar lock assembly 10 in a closed and locked position. In FIG. 2, the bar lock assembly 10 is opened, while the door 500 is still closed. In FIG. 3, the door 500 is opened, thus revealing the cargo area 420.

Figure 4:
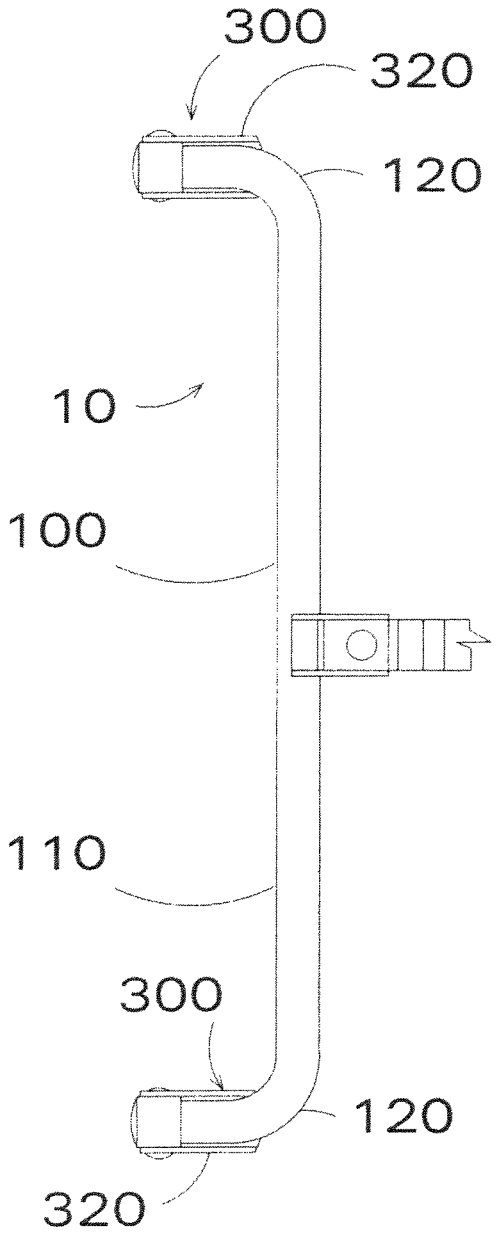
FIG. 4 is a view of the bar lock assembly.

With reference to FIG. 4, the bar lock assembly 10 is shown in detail. The bar lock assembly 10 comprises a tubular bar 100 having oppositely disposed curved portions 120 on either side of a middle portion 110 of the tubular bar 100. The curved portions 120 comprise an approximately 90° round bend in the tubular bar 100 relative to the middle portion 110. A handle 200 is rotatably connected to the tubular bar 100. The tubular bar 100 and its curved portions 120 maintain a generally constant diameter throughout the length of the tubular bar 100 and the 90° round bends leading to the curved portions 120. The tubular bar 100 comprises a single tubular bar 100 with integral curved portions 120.

Figure 5:
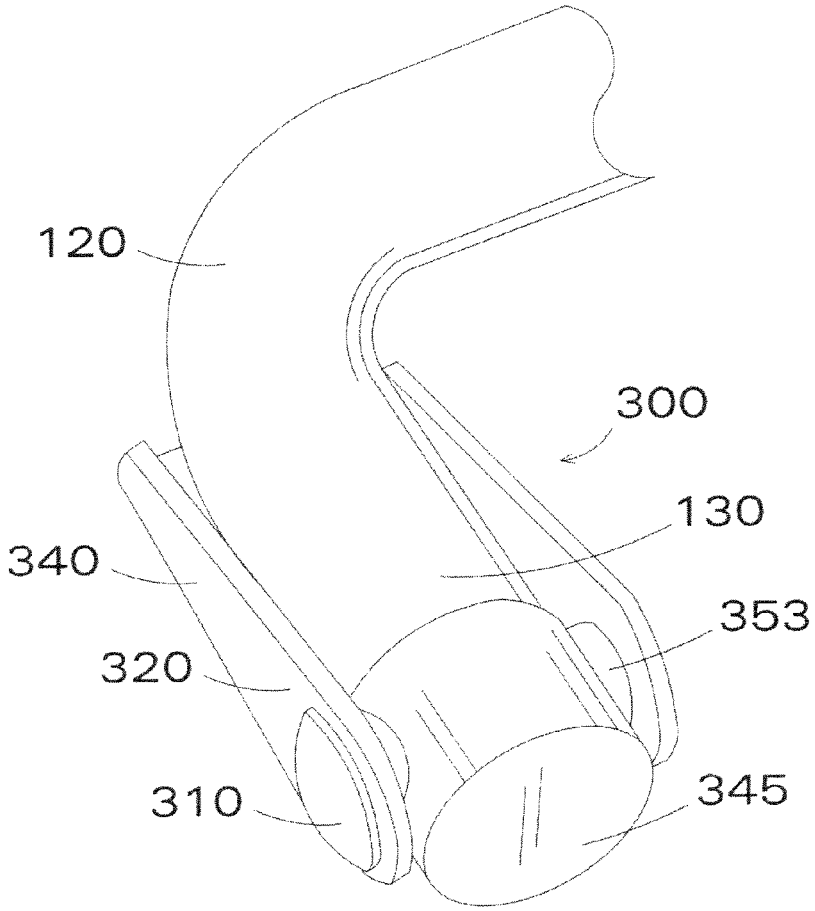
FIG. 5 is a view of the hinge assembly.
Figure 6:
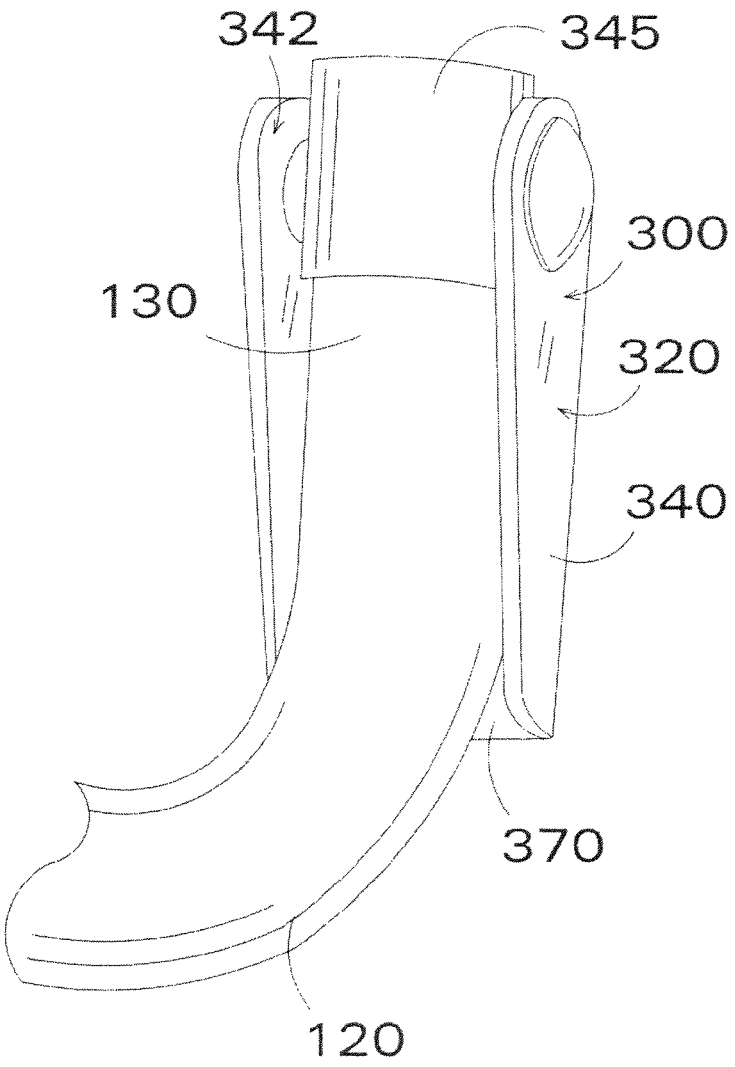
FIG. 6 is a further view of the hinge assembly.

With reference to FIGS. 5 and 6, the curved portions 120 of the tubular bar 100 transitions into hinge receiving portions 130 of the tubular bar 100. As such, the tubular bar 100 comprises a single tubular bar 100 with integral curved portions 120 that transition into integral hinge receiving portions 130.

Figure 7A:
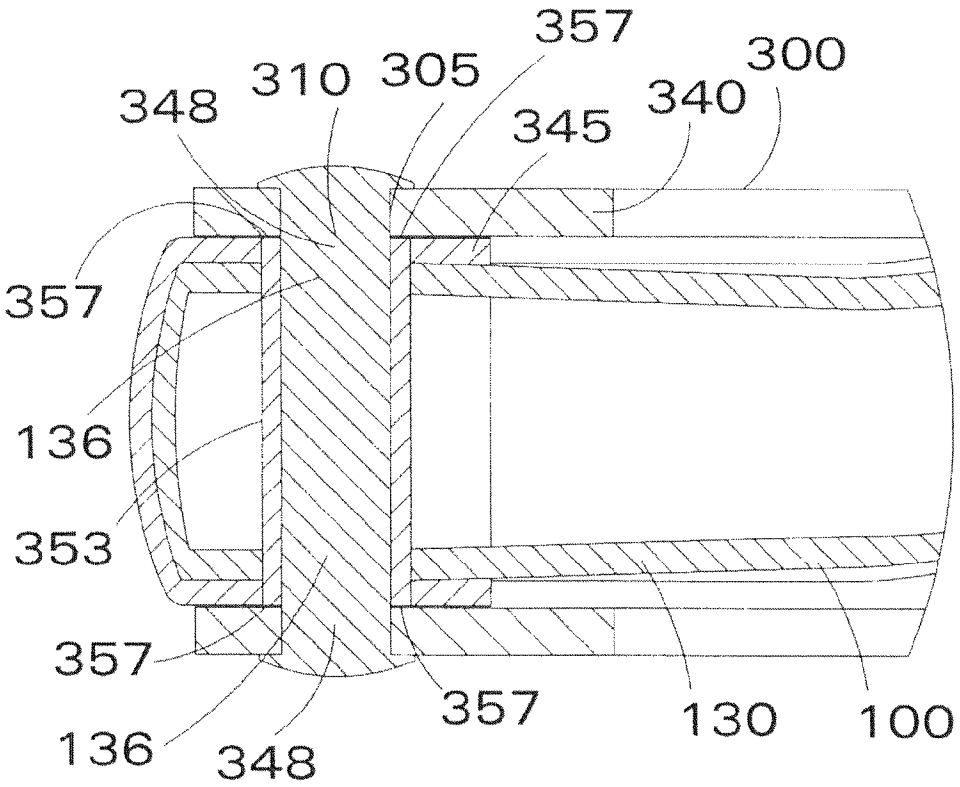
FIG. 7(*a*) is a sectional view of the hinge assembly.
Figure 7B:
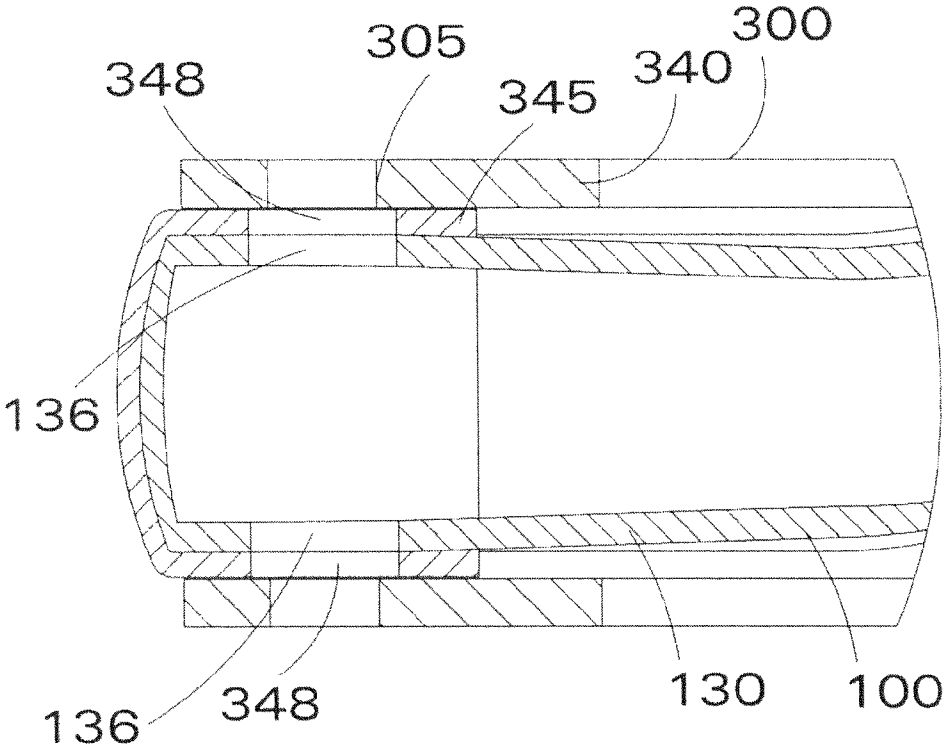

With reference to FIGS. 7(*a*) and 7(*b*), the hinge receiving portions 130 of the tubular bar 100 are rotatably engaged to hinge assemblies 300. Each hinge assembly 300 comprises a bracket 320, a bushing 353, a rivet 310, and a plastic cover 345. The bracket 320 includes bent-up side faces 340 having bracket holes 305. The bent-up sides 340 extend from a base 370. The bushing 353 is tubular and has an inside diameter that is approximately equal to the bracket holes 305. The bushing 353 has an outside diameter that is larger than the bracket holes 305 and is equal to or slightly smaller than cross-holes 136 in the hinge receiving portions 130 of the tubular bar 100. The length of the bushing 353 is substantially equal to the space between the bent-up side faces 340 of the bracket 320. The bushing 353 slides through cross holes 136 in the hinge receiving portion 130 of the tubular bar 100 and slides through cross holes 348 in the plastic cover 345. In FIG. 7(*b*), the bushing 353 and the rivet 310 are removed for illustrative purposes to show the cross-holes 136 in the hinge receiving portion 130 of the tubular bar 100 and the cross-holes 348 in the plastic cover 345.

As shown in FIG. 7(*a*), the rivet 310 slides through the bushing 353 and through the holes 305 of the bracket 320. When the rivet 310 is secured in or to the hinge assembly 300 (by staking, orbital riveting, welding, or other suitable process), ends 357 of the bushing 353 are secured against an interior surface 342 (shown in FIG. 8) of the bent-up side faces 340 of the bracket 320. The interaction of the bushing 353 with the bent-up side faces 340 of the bracket 320 makes the hinge assembly 300 substantially stronger as a "box-like" structure is formed.

The bracket 320 receives the rivet 310, which passes through the bushing 353 and the openings 305 in the bracket 320. The bushing 353 provides for the hinge receiving portion 130 of the tubular bar 100 to rotate about the bracket 320 in a range of approximately 180° to approximately 320°. The plastic cover 345 assists in stabilizing the hinge receiving portion 130 to the hinge assembly 300 and enclosing an end of the tubular bar 100.

Figure 8:
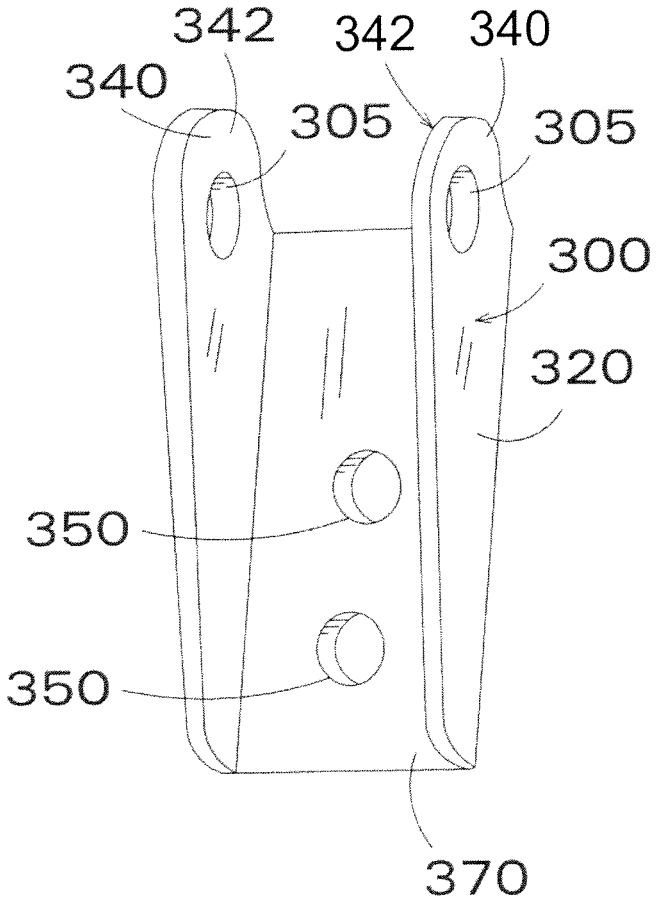
FIG. 8 is a view of the bracket portion of the hinge assembly.

With reference to FIG. 8, the hinge assembly 300 includes one or more holes 350 for mounting the hinge assembly 300 to the door frame 400 of the cargo area 420 using bolts or screws. In this embodiment, the holes 350 are positioned in the base 370 of the hinge assembly 300. The hinge assembly may omit the holes 350 and be fastened to the door frame 400 using other conventional techniques, such as rivets, welds, adhesives, nails, etc.

The cargo area 420 is provided with the door 500 that moves into open and closed positions. The door 500 is generally mounted adjacent the cargo area 420. The door is hingedly or slidably connected to the door frame 400. The bar lock assembly 10 secures the door 500 while the door 500 is in a closed position.

Figure 9:
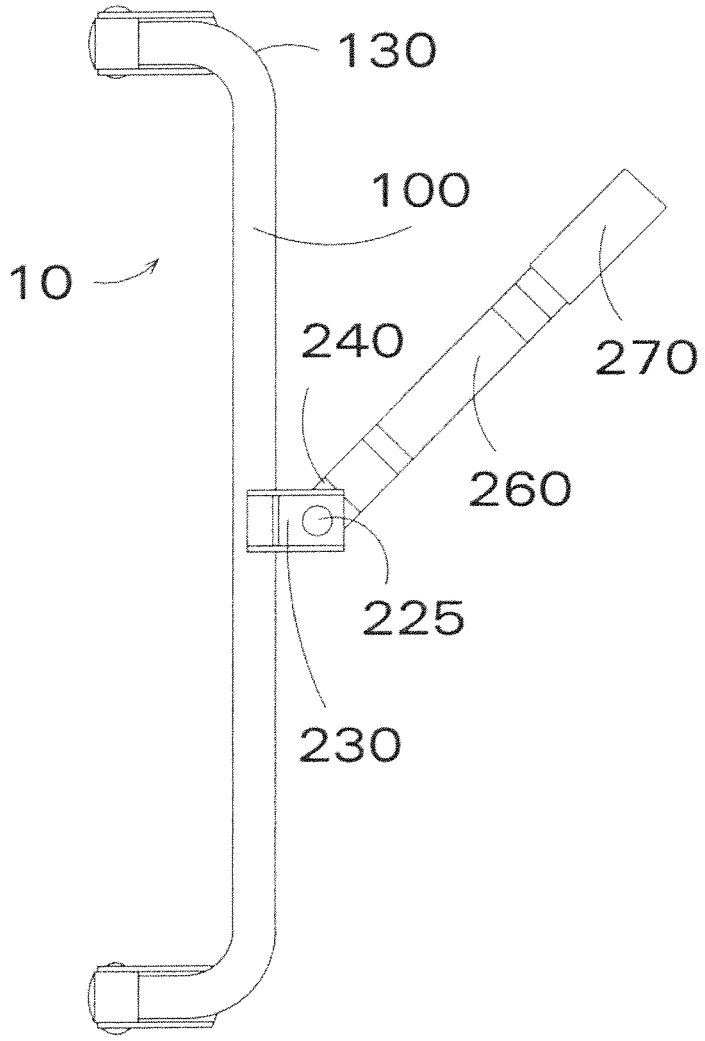
FIG. 9 is a view of the handle.
Figure 10:
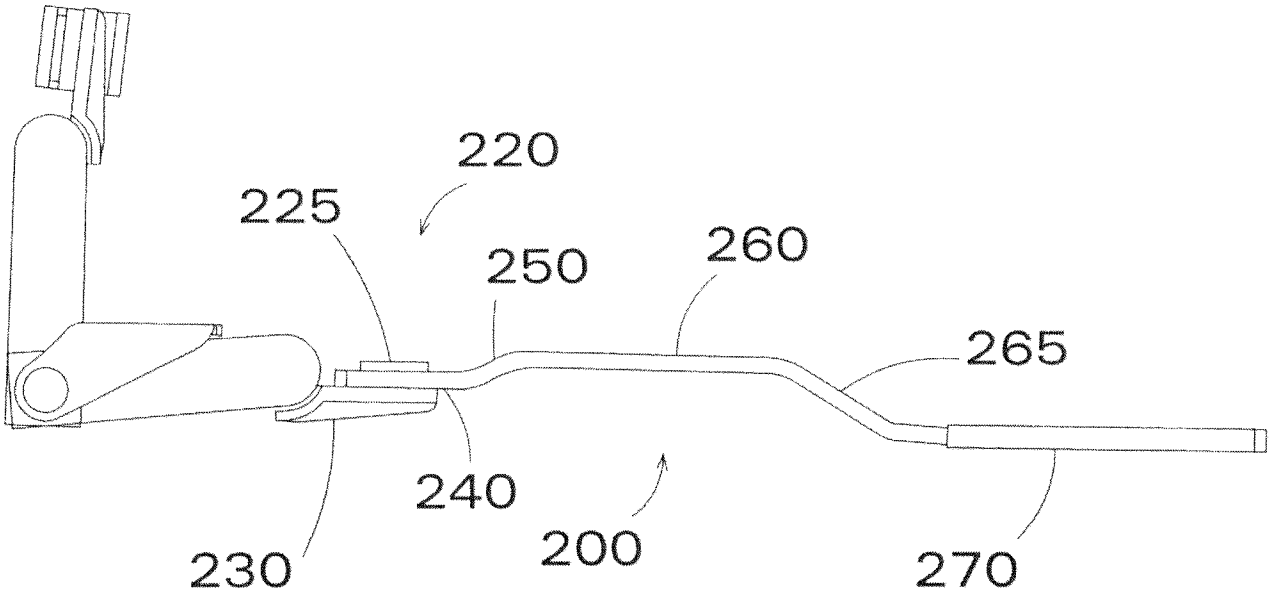
FIG. 10 is a side view of the handle
Figure 11:
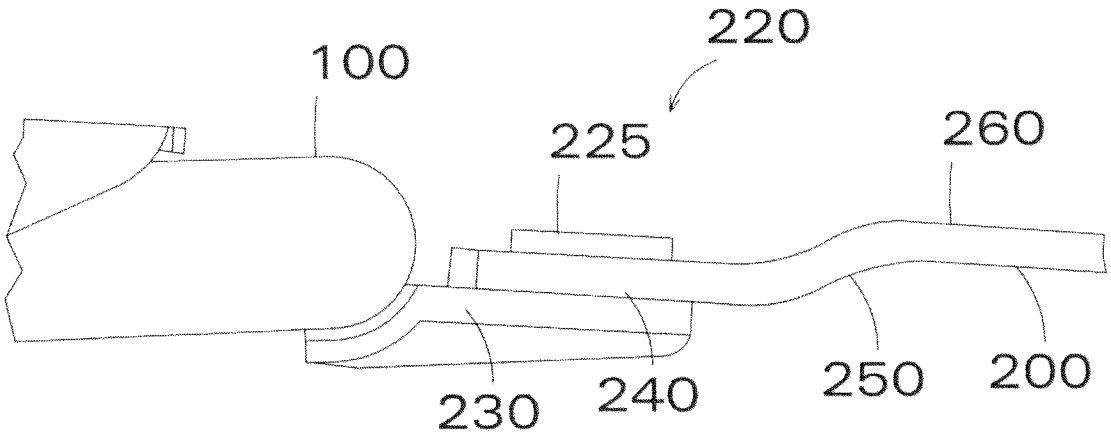
FIG. 11 is a side view of the handle focusing on the rotation element of the handle.

With reference to FIGS. 9-11, the handle 200 extends from the middle portion 110 of the tubular bar 100. The handle 200 rotates relative to the tubular bar 100 via a rotatable joint 220. The rotatable joint 220 connects a tubular bar portion 230 and a handle receiving portion 240 mounted via a rotation element 225. The tubular bar portion 230 attaches to the rotatable joint 220 opposite of the handle receiving portion 240. From the rotatable joint 220, the handle receiving portion 240 transitions into a first angle portion 250, which transitions into a locking portion 260.

Figure 12:
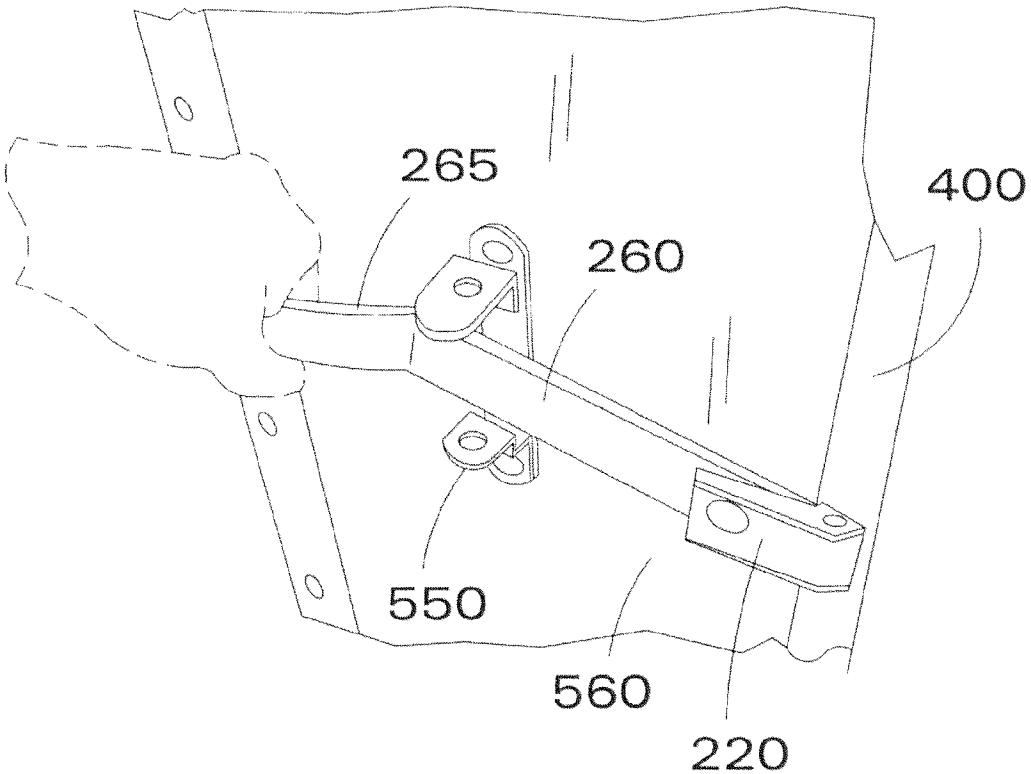
FIG. 12 is a view of the handle moving to the locking position.

As shown in FIG. 10, the locking portion 260 has a generally planar structure. As shown in FIG. 12, the locking portion 260 is received by a U-shaped locking member 550 mounted integrally or attached to the door 500 or a door surface 560. A second angled portion 265 transitions from the locking portion 260 to a handle portion 270. The handle receiving portion 240 and the handle portion 270 are generally collinear.

In operation, as shown in FIG. 12, the user grasps the handle portion 270 of the handle 200 and swings the handle 200 via the rotatable joint 220 from the U-shaped locking member 550 into an open position where the bar lock assembly 10 is unlocked. In order to lock the door 500, the user swings the handle 200 in an opposite direction and the handle 200 of the bar lock assembly 10 engages the U-shaped locking member 550. In the locked position, the handle 200 is urged into the U-shaped locking member 550, and then the handle 200 is urged by the U-shaped locking member 550 against the surface 560 of the door 500. The U-shaped locking member 550 may include a locking device such as a padlock that securely closes the handle portion 270 in the U-shaped locking member 550. The handle portion 270 and U-shaped locking member 550 may be provided with holes that receive the padlock for additional security.

Figure 13:
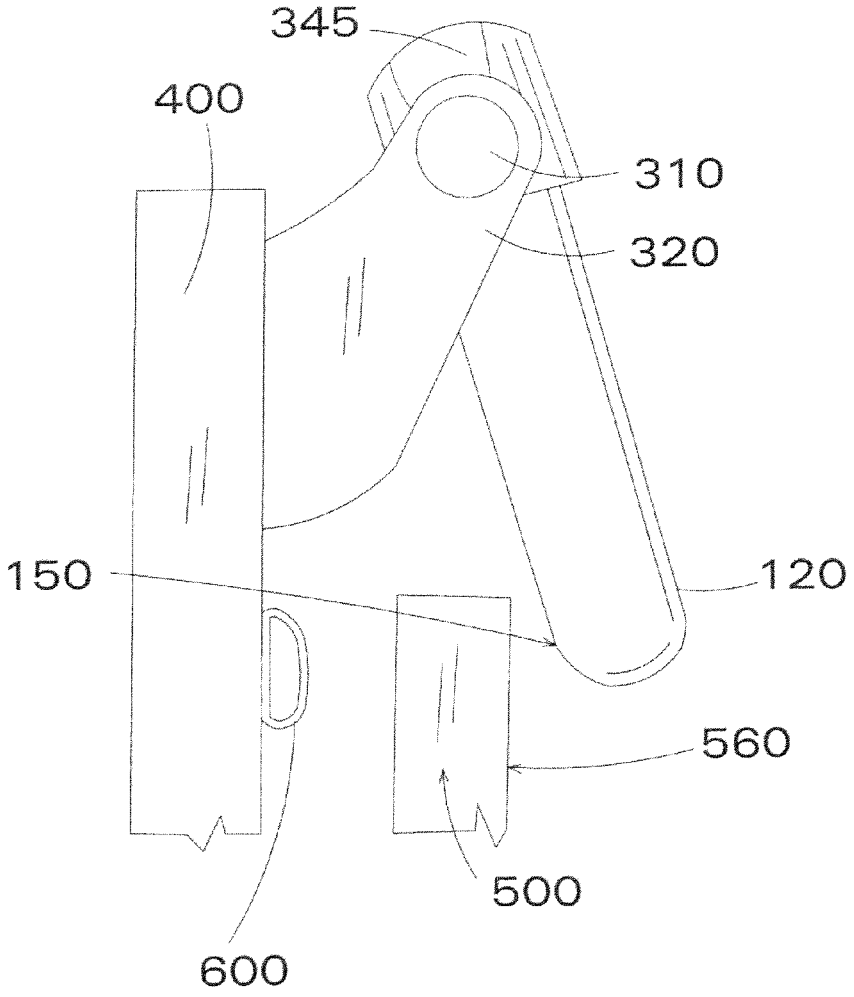
FIG. 13 is a view of the tubular bar in position to contact the door.
Figure 14:
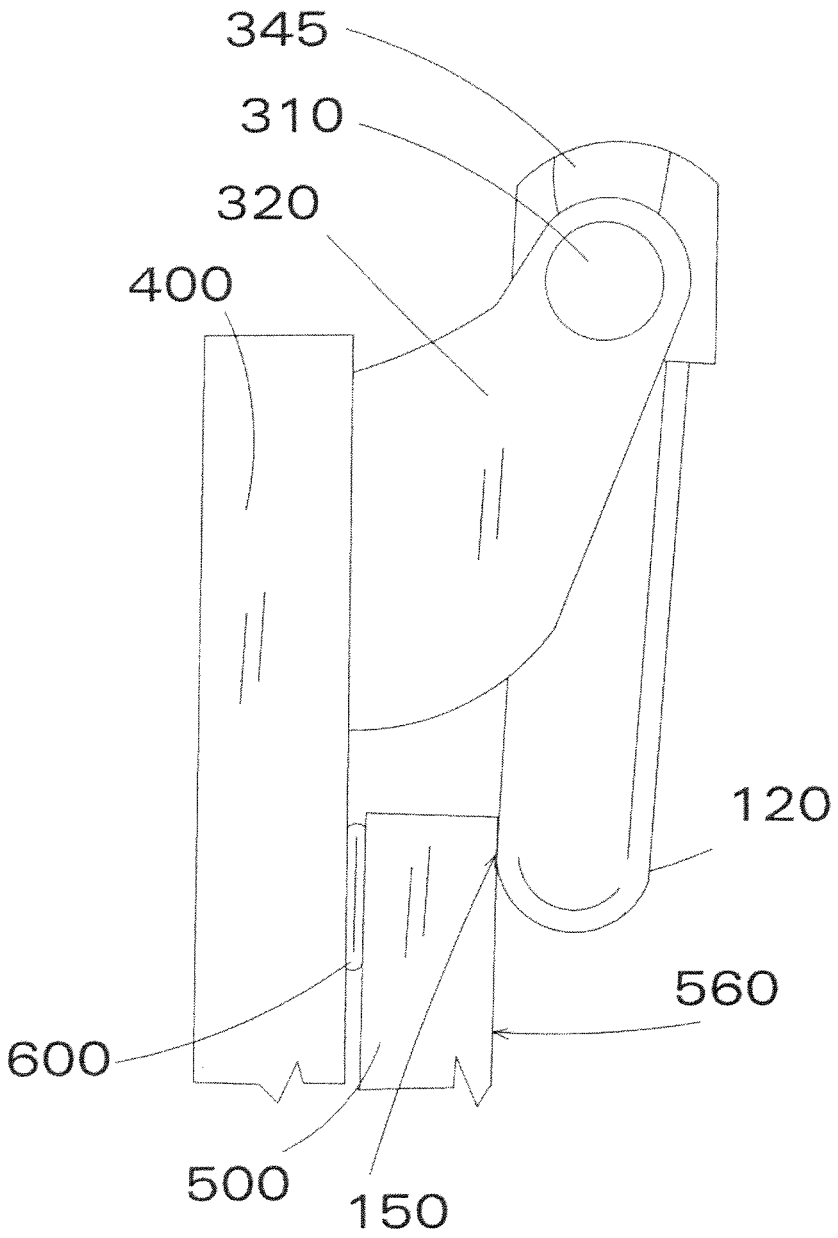
FIG. 14 is a view of the tubular bar contacting the door and compressing the seal.
Figure 15:
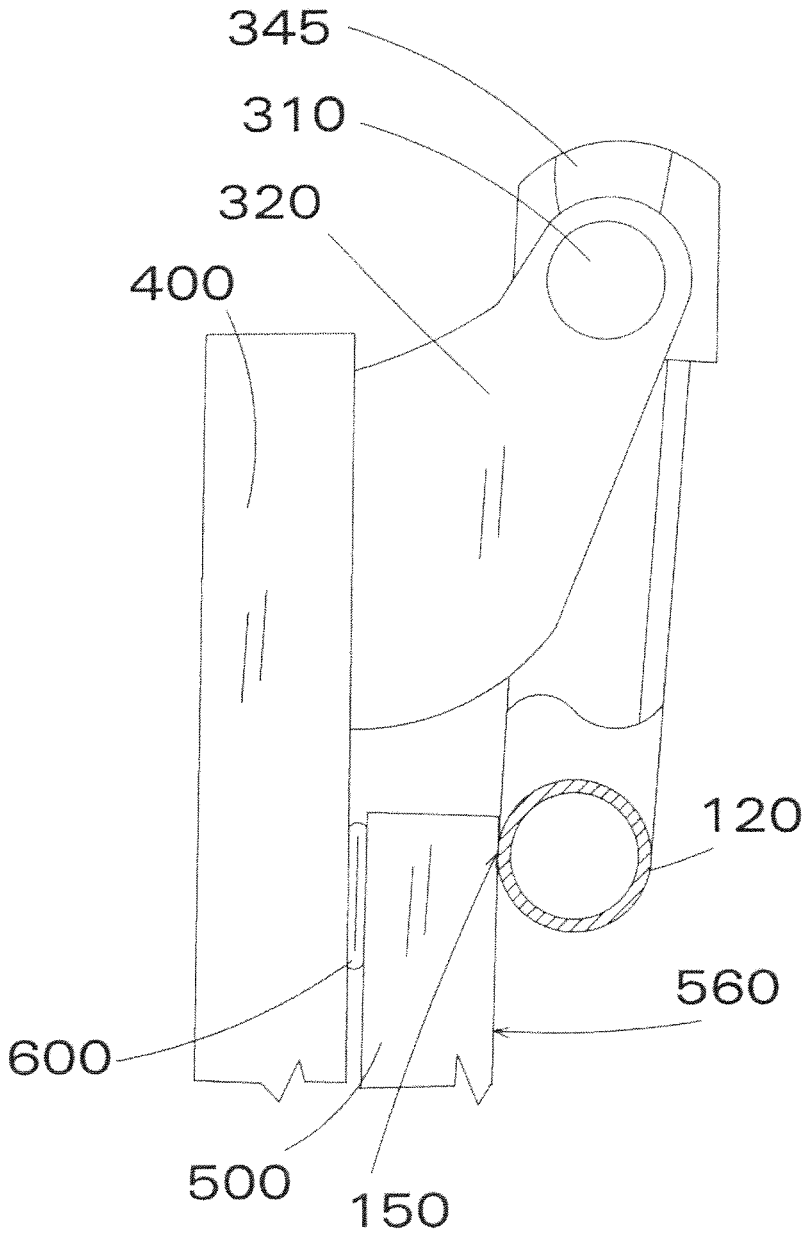
FIG. 15 is a cross-sectional view of the tubular bar contacting the door.

During a closing procedure of the bar lock assembly 10 as shown in FIGS. 13-15, the force of the locking portion 260 pushing into the U-shaped locking member 550 forces nearly or approximately the entire length of a contact surface 150 of the tubular bar 100 against the surface 560 of the door 500. The contact surface 150 is the exterior surface of the tubular bar 100 in contact with the surface 560 of the door 500. This provides a closing force approximately all along the length of the tubular bar 100 against the surface 560 of the door 500 to adequately compress a seal 600.

The tubular bar 100 generally comprises a tubular member of bar stock having a generally uniform diameter, including a generally uniform diameter through the curved portion 120. This provides for the contact surface 150 of the tubular bar 100 to press against the door 500 along nearly the entire length of the tubular bar 100 in order to provide a constant closing pressure against the door 500. If the tubular bar 100 did not have a uniform diameter, then the tubular bar 100 would apply uneven pressure to the surface 560 of the door 500, resulting in poor closure or in poor sealing and possibly warping the door 500.

The design of the bar lock assembly 10 eliminates most of the welds found in prior art devices. The welds of the prior art devices are manually intensive to form and tend to corrode and eventually fail. As such, the bar lock assembly 10 provides a locking structure with increased ability to withstand environmental pressures from corrosion and improved durability. The bar lock assembly 10 further reduces the number of components for forming the bar lock assembly 10, as compared to existing devices, thus reducing material and manufacturing costs.

The amount of rotation provided by the hinge 300 allows for the bar 100 to be rotated out of the way of the opening of the cargo area 420 such that the cargo area 420 may be loaded without a locking assembly obstructing the cargo area 420. The uniform pressure provided by the tubular bar 100 as it presses against the door 500 assists in fully engaging the door 500 against the seal 600 around the frame 400. In other embodiments, the seal 600 may be attached to the door 500.

The present invention provides a bar lock assembly 10 wherein the tubular bar 100 forms an integral part of the hinge assembly 300, i.e., the tubular bar 100 transitions via the curved portion 120 into the hinge portion 130 that receives the rivet 310 of the hinge assembly 300. Said another way, the bar lock assembly 10 uses a single bent tubular bar 100 that integrates the linear compressing area of the tubular bar 100 and a rotating end of the hinge assembly 300 into a single formed piece.

The tubular bar 100, handle 200, and hinge assembly 300 may be constructed from a variety of metals and metal alloys, including varieties of steel or aluminum. In order to reduce weight and manufacturing costs, the tubular bar 100 may be made hollow.

The tubular bar 100 has a generally constant diameter, which for different versions, may range from approximately ½ inch to 2 inches. A suitable tubular 100 for most cargo truck applications has a diameter of approximately 1 inch. The tubular bar 100 has a length of approximately 12 inches to approximately 84 inches between the curved portions 120.

Those skilled in the art will appreciate that variations from the specific embodiments disclosed above are contemplated by the invention. The invention should not be restricted to the above embodiments, but should be measured by the following claims.

What is claimed:

1. A bar lock assembly, comprising:

a tubular bar comprising opposed curved portions that transition into hinge receiving portions, each hinge receiving portion having a hinge end, wherein the tubular bar comprises a generally uniform diameter through the hinge receiving portions and the hinge ends;

a handle rotatably engaged to the tubular bar, and the handle rotates to engage a locking member mounted on a door, wherein the door is connected to a door frame by a connection;

a pair of hinge assemblies that secure the hinge end of each of the hinge receiving portions of the tubular bar, wherein the hinge assemblies connect or attach the bar lock assembly to the frame of the door opposite of the connection between the door and the door frame, wherein each of the hinge assemblies have a base member and bent sides extending upwardly from the base member forming a receiving channel that is configured to receive the hinge receiving portion when the handle engages the locking member; and, the opposed curved portions of the tubular bar directly contact a front surface of the door and provide a closing pressure to the front surface of the door when the handle engages the locking member.

2. The bar lock assembly according to claim 1, wherein the tubular bar comprises a generally uniform diameter through the curved portions to provide a constant closing pressure to the door.

3. The bar lock assembly according to claim 1, wherein the hinge receiving portions receive a rivet and a bushing to rotatably connect the hinge receiving portion to the hinge assembly.

4. The bar lock assembly according to claim 1, wherein the tubular bar is hollow.

5. The bar lock assembly according to claim 1, wherein the tubular bar comprises a middle portion between the curved portions, and the curved portions are bent at approximately 90° relative to the middle portion.

6. The bar lock assembly according to claim 1, wherein the opposed curved portions contact the front surface of the door to provide a constant closing pressure on the door.

7. The bar lock assembly according to claim 1, wherein the tubular bar forms an integral part of the hinge assemblies.

8. The bar lock assembly according to claim 1, wherein the tubular bar comprises a single tubular bar with integral curved portions that transition into integral hinge receiving portions.

9. The bar lock assembly according to claim 8, wherein the hinge assemblies comprise brackets that receive a rivet and a bushing that pass through the hinge receiving portions of the tubular bar.

10. The bar lock assembly according to claim 9, wherein the rivet passes through the bushing and through holes in opposite sides of the bracket, and the bushing is in between the opposite sides of the bracket.

11. The door comprising the bar lock assembly according to claim 1, wherein the door is mounted adjacent a cargo or a storage area to cover the cargo or the storage area, and wherein the connection between the door and the door frame is a hinging connection.

12. The door according to claim 1, wherein each hinge assembly comprises a bracket that is in a rotational engagement with the hinge receiving portion, and the bracket is mounted onto the frame of the door.

13. The door according to claim 12, wherein the bar lock assembly rotates in a range of approximately 180° to approximately 320° relative to the brackets.

14. The bar lock assembly according to claim 1, wherein the hinge receiving portions and the curved portions are not welded to the tubular bar.

15. A bar lock assembly, comprising:

a tubular bar comprising opposed integral curved portions that transition into integral hinge receiving portions, each hinge receiving portion has an integral hinge end, wherein the curved portions comprise an approximately 90° round bend leading to the hinge receiving portions, wherein the tubular bar comprises a generally uniform diameter through the hinge receiving portions and the hinge ends;

a handle rotatably engaged to the tubular bar, the handle rotates to engage a locking member mounted on a door, and exterior surfaces of the opposed integral curved portions and a length of the tubular bar press against a front surface of the door and provides a closing force against the front surface of the door;

the hinge end of each of the hinge receiving portions of the tubular bar is rotatably connected to a pair of brackets via rivets, which provides the tubular bar approximately 180° to approximately 320° of rotation relative to the brackets, and wherein each the brackets have a base member and bent sides extending upwardly from the base member forming a receiving channel that is configured to receive the hinge receiving portion when the handle engages the locking member.

16. The bar lock assembly according to claim 15, wherein the tubular bar comprises a generally uniform diameter.

17. A door comprising the bar lock assembly according to claim 15.

18. A method of using a bar lock assembly to lock or secure a door, comprising:

providing a bar lock assembly comprising a single tubular bar with oppositely disposed curved portions that transition into hinge receiving portions, each hinge receiving portion having a hinge end, wherein the tubular bar comprises a generally uniform diameter through the curved portions and the hinge receiving portions and the hinge ends; a handle rotatably engaged to the tubular bar; and a pair of hinge assemblies that secures the hinge end of each of the hinge receiving portions of the tubular bar, and wherein each of the hinge assemblies have a base member and bent sides extending upwardly from the base member forming a receiving channel that is configured to receive the hinge receiving portion when the handle engages the locking member;

attaching the bar lock assembly to a frame of the door opposite of a connection between the door and the door frame;

rotating the bar lock assembly;

rotating the handle to engage a locking member mounted on a door; and contacting approximately an entire length of the single tubular bar and the oppositely disposed curved portions directly against a front surface of the door and exerting a closing force on the door.

19. The method according to claim 18, wherein the single tubular bar provides a closing force along approximately the entire length of the single tubular bar against the front surface of the door.

20. A door and bar lock assembly, comprising:

a door, the door comprising a locking member, wherein the door is connected to a door frame by a connection at a first position on the door frame;

a tubular bar comprising a middle portion and integral curved portions on both sides of the middle portion, and the curved portions transition into hinge receiving portions, wherein the tubular bar comprises a generally uniform diameter through the hinge receiving portions, wherein the hinge receiving portions of the tubular bar include oppositely disposed cross holes, and a bushing slides through the cross holes;

a pair of hinge assemblies that secure to a hinge end of the hinge receiving portions of the tubular bar via the cross holes and the bushing, wherein the hinge assemblies connect or attach the tubular bar to the frame of the door at a second position on the door frame, a handle rotatably engaged to the tubular bar, and the handle rotates to engage the locking member of the door; wherein the hinge assemblies having opposing sides with opposing through holes, the opposing sides forming a receiving channel that is configured to receive the hinge receiving portion when the handle engages the locking member, and the through holes receive the bushing, an exterior surface of the curved portions and the middle portion contacts a front surface of the door when the handle engages the locking member and exerts a closing force on the front surface of the door.

21. A bar lock assembly, comprising:

a tubular bar comprising opposed curved portions that transition into hinge receiving portions, each hinge receiving portion having a hinge end, wherein the tubular bar comprises a generally uniform diameter through the hinge receiving portions;

a handle rotatably engaged to the tubular bar, and the handle rotates to engage a locking member mounted on a door, wherein the door is connected to a first side of a door frame by a door hinge;

a pair of hinge assemblies that secure the hinge end of each of the hinge receiving portions of the tubular bar, wherein the hinge assemblies connect or attach the bar lock assembly to a second side of the door frame, wherein each of the hinge assemblies have a base member and bent sides extending upwardly from the base member forming a receiving channel that is configured to receive the hinge receiving portion when the handle engages the locking member; and, the tubular bar directly contacts the door when the handles engages the locking member to urge the door to a closed position.

22. A bar lock assembly, comprising:

a generally hollow tubular bar comprising a middle portion and integral curved portions on both sides of the middle portion, and the curved portions transition into hinge receiving portions, wherein the curved portions comprise an approximately 90° round bend leading to the hinge receiving portions, wherein the hinge receiving portions of the tubular bar include oppositely disposed cross holes, and a fastener slides through the cross holes and through a generally hollow interior of the hinge receiving portions;

hinge assemblies that secure to the hinge receiving portions of the tubular bar via the fastener further passing through the hinge receiving assemblies, wherein the hinge assemblies are configured to connect or attach the tubular bar to a frame of a door, wherein of the hinge assemblies have a base member and opposite sides extending upwardly from the base member forming a receiving channel that is configured to receive the hinge receiving portion when the handle engages the locking member; and, a handle rotatably engaged to the tubular bar, and the handle rotates to engage a locking member of the door.

23. The bar lock assembly according to claim 22, wherein a bushing slides through the cross-holes, and the fastener passes through the bushing.

24. The bar lock assembly according to claim 22, wherein the fastener passes through the opposite sides of the hinge receiving assemblies.

25. The bar lock assembly according to claim 22, wherein the fastener passes through a bushing and through holes in the opposite sides of the hinge receiving assemblies, and the bushing is in between the opposite sides of the hinge receiving assemblies.

* * * * *